US005988868A

United States Patent [19]

Dedoes

[11] Patent Number: 5,988,868

[45] Date of Patent: Nov. 23, 1999

[54] DRIVE MEMBER FOR AUTOMATIC PAINT STIRRING EQUIPMENT

[75] Inventor: John T. Dedoes, Brighton, Mich.

[73] Assignee: Dedoes Industries, Inc., Walled Lake, Mich.

[21] Appl. No.: 09/153,516

[22] Filed: Sep. 15, 1998

[51] Int. Cl.[6] ..... B01F 7/20

[52] U.S. Cl. ..... 366/198; 366/605

[58] Field of Search ..... 366/197, 198, 366/242–251, 331, 605

[56] References Cited

U.S. PATENT DOCUMENTS

| | | | |
|---|---|---|---|
| D. 356,585 | 3/1995 | Hersant et al. . | |
| 2,428,492 | 10/1947 | Haller . | |
| 2,521,384 | 9/1950 | Marienthal | 366/249 |
| 2,757,910 | 8/1956 | O'Neill | 366/605 |
| 2,802,649 | 8/1957 | Stockton | 366/197 |
| 2,965,363 | 12/1960 | Worden | 366/197 |
| 3,021,118 | 2/1962 | Dedoes | 366/247 |
| 3,041,052 | 6/1962 | Dedoes | 366/247 |
| 3,118,653 | 1/1964 | Dedoes | 366/251 |
| 3,175,808 | 3/1965 | Dedoes | 366/605 |
| 4,136,532 | 1/1979 | Okuda . | |
| 4,162,618 | 7/1979 | Okuda . | |
| 4,225,248 | 9/1980 | Para | 366/251 |
| 4,299,500 | 11/1981 | Bassetti | 366/198 |
| 4,407,584 | 10/1983 | Boudin et al. | 366/279 |
| 4,427,398 | 1/1984 | Eisbrecher et al. . | |
| 4,540,305 | 9/1985 | Geisthoff et al. . | |
| 4,692,127 | 9/1987 | Wagner . | |
| 5,020,700 | 6/1991 | Krzywdziak et al. . | |
| 5,080,634 | 1/1992 | Makase . | |
| 5,096,071 | 3/1992 | Neri | 366/605 |
| 5,098,343 | 3/1992 | Tysver et al. . | |
| 5,160,198 | 11/1992 | Fillon | 366/605 |
| 5,169,232 | 12/1992 | Fillon et al. | 366/605 |
| 5,195,840 | 3/1993 | Ruschke et al. . | |
| 5,263,899 | 11/1993 | Nozaki et al. . | |
| 5,310,258 | 5/1994 | Godat et al. | 366/605 |
| 5,358,153 | 10/1994 | Caldwell et al. . | |
| 5,360,376 | 11/1994 | Baldino . | |
| 5,368,388 | 11/1994 | Fillon | 366/245 |
| 5,368,389 | 11/1994 | Dedoes | 366/247 |
| 5,413,257 | 5/1995 | Amberger et al. . | |
| 5,437,385 | 8/1995 | Fillon . | |
| 5,454,639 | 10/1995 | Krzywdziak | 366/279 |

(List continued on next page.)

FOREIGN PATENT DOCUMENTS

| | | | |
|---|---|---|---|
| 0 035 422 A1 | 9/1981 | European Pat. Off. . | |
| 127589 | 12/1984 | European Pat. Off. | 366/605 |
| 0298806 A1 | 1/1989 | European Pat. Off. . | |
| 2102417 | 4/1972 | France | 366/198 |
| 2521493 | 8/1983 | France | 366/605 |
| 2562874 | 10/1985 | France . | |
| 2742072 | 1/1998 | France . | |
| 858607 | 12/1952 | Germany | 366/197 |
| 2203059 | 10/1988 | United Kingdom | 366/605 |

*Primary Examiner*—Charles E. Cooley
*Attorney, Agent, or Firm*—Gifford, Krass, Groh, Sprinkle, Anderson & Citkowski, P.C.

[57] ABSTRACT

An improvement in automatic paint stirring equipment is disclosed of the type having a rack adapted to removably receive and support a plurality of paint cans. Each paint can includes a cover, a stirring element contained within the can and a driven member positioned above the cover and mechanically connected to the stirring element. The driven member is rotatable about a predetermined axis and includes two upwardly extending pins spaced apart from each other by a preset distance. A drive shaft is rotatably mounted to the rack and rotatably driven by a motor about a generally vertical axis. A drive member is secured to the lower end of the shaft and rotates in unison with the shaft. The improved drive member includes two outer legs and a central leg. Each leg is substantially planar and the outer legs intersect the central leg at an obtuse angle such that the outer legs are substantially parallel to each other. Furthermore, the central leg is dimensioned so that the intersections of the outer legs with the central leg are spaced apart from each other by a distance substantially equal to the distance between the pins on the driven members.

5 Claims, 3 Drawing Sheets

U.S. PATENT DOCUMENTS

| | | | |
|---|---|---|---|
| 5,456,534 | 10/1995 | Krzywdziak | 366/605 |
| 5,482,370 | 1/1996 | Dedoes | 366/605 |
| 5,496,109 | 3/1996 | Dedoes | 366/605 |
| 5,498,076 | 3/1996 | Krzywdziak | 366/245 |
| 5,498,077 | 3/1996 | Krzywdzjak et al. | 366/605 |
| 5,503,474 | 4/1996 | Krzywdziak | 366/347 |
| 5,511,878 | 4/1996 | Dedoes et al. | 366/605 |
| 5,542,761 | 8/1996 | Dedoes | 366/605 |
| 5,586,822 | 12/1996 | Krzywdziak | 366/247 |
| 5,603,426 | 2/1997 | Krzywdziak et al. . | |
| 5,622,289 | 4/1997 | Dedoes . | |
| 5,697,703 | 12/1997 | Lucchetti | 366/605 |
| 5,800,057 | 9/1998 | Lesimple | 366/249 |

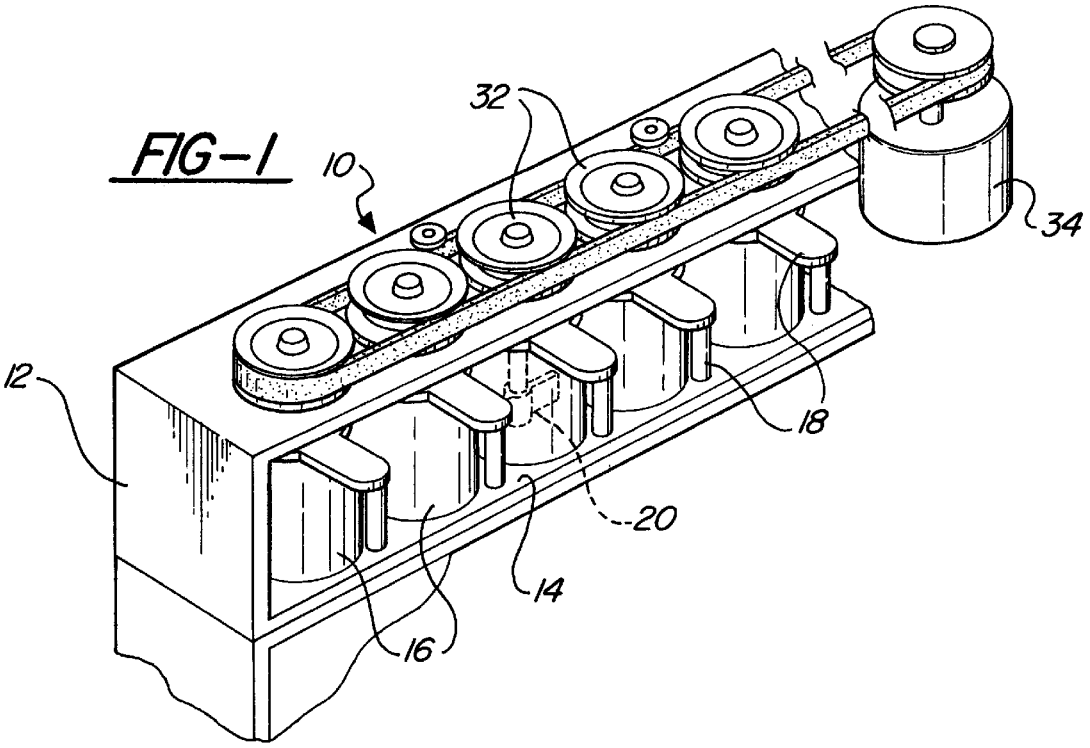
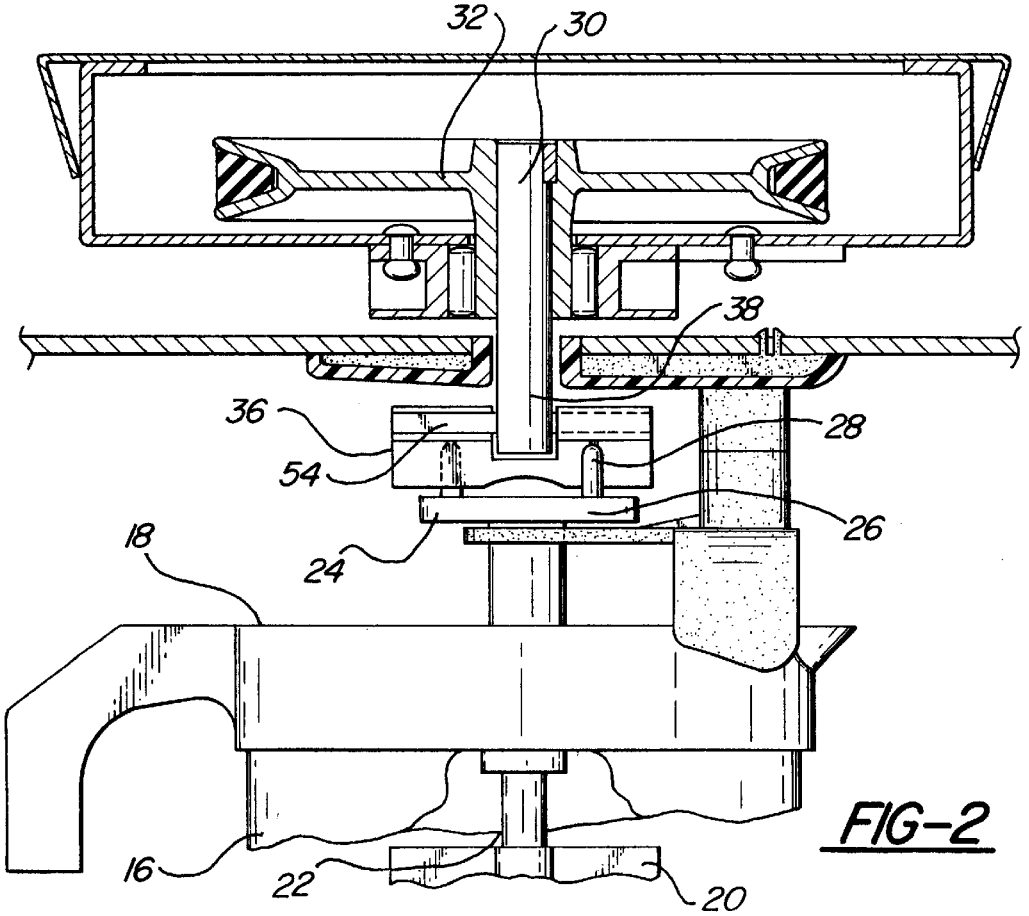
FIG-2

DRIVE MEMBER FOR AUTOMATIC PAINT STIRRING EQUIPMENT

BACKGROUND OF THE INVENTION

1. Field of the Invention

The present invention relates generally to automatic paint stirring equipment and, more particularly, to an improved drive member for such equipment.

2. Description of the Prior Art

Automatic paint stirring equipment of the type commonly found in automotive paint shops typically comprise a rack adapted to removably receive and support paint cans. The paint cans, furthermore, include a cover which extends across the top of the paint can. A stirring element is rotatably mounted to the paint can cover. The stirring element typically includes a paddle contained within the interior of the can as well as a driven member positioned above the paint can cover.

The paint can rack is designed to removably receive and support the paint cans once they are positioned within the rack. In one previously known type of automatic paint stirring equipment, horizontally extending shelves are provided across the rack for supporting the bottoms of the paint cans.

Once the paint can is positioned within the rack, the driven member of the stirring assembly is mechanically coupled with a drive member mounted to the rack. This drive member mounted to the rack, furthermore, is rotatably driven by a motor contained so that the rotation of the drive member mechanically engages the driven member on the stirring element so that the stirring element and drive member rotate in unison with each other.

In one type of previously known driven member, the driven member comprises an arm having two upwardly extending pins. The pins are equidistantly spaced from the center of rotation of the stirring element. Thus, once the cans are inserted into the rack, the pins stick upwardly from the top of the cover on the paint can.

In order to rotatably drive the driven member, a generally planar drive member is secured to the shaft rotatably mounted to the rack above the paint can. The drive member is positioned to fit in between the upwardly extending pins of the driven member so that, upon insertion of the paint can into the rack and rotation of the drive member by the drive shaft, the drive member rotatably drives the driven member with its attached stirring element.

One disadvantage of the previously known automatic paint stirring equipment is that, in order for the drive member to engage and rotatably drive the driven member, it was necessary that the paint can be accurately positioned on the rack such that the axes of rotation of both the drive shaft and driven member were coaxial. Otherwise, the drive member would simply push the driven member together with the paint can to one side such that the drive member disengaged from the driven member.

In order to achieve the coaxial alignment between the axes of the drive member and driven member, is has been the previously known practice to attach centering guides to the rack shelf such that, upon insertion of the paint can into the rack, the guides automatically center and align the drive and driven members together.

While the previously known method for aligning the axes of the drive member and driven member is effective in operation, the guides that are attached to the shelf interfere with the efficient cleaning of the shelf of paint and other debris. In order to completely clean the shelf, it has been necessary to actually remove the guides from the shelf, clean the shelf and then replace the guides. More commonly, however, paint and other debris merely accumulated around the guides which were left on the shelves during the shelf cleaning.

SUMMARY OF THE PRESENT INVENTION

The present invention provides an improved drive member for automatic paint stirring equipment which overcomes the above-mentioned disadvantages of the previously known devices.

In brief, the automatic paint stirring equipment of the present invention includes a rack which is adapted to slidably receive and support paint cans by horizontally extending shelves. Each paint can includes a cover, a stirring element contained within the cover and a driven member positioned above the cover and mechanically connected to the stirring element. The driven member rotates about a predetermined and generally vertical axis which simultaneously rotates the stirring element to stir the paint in the can. The driven member is conventional in construction and includes a horizontally extending arm having two upwardly extending pins which are equidistantly spaced apart from the axis of rotation of the driven member and diametrically opposed from each other.

The paint stirring equipment further includes a drive shaft which is rotatably mounted to the rack about a vertical axis. A motor contained within the paint stirring equipment rotatably rotates the drive shaft about a vertical axis above each paint can.

An improved drive member is secured to a lower end of the drive shaft so that the drive member rotates in unison with the drive shaft. Unlike the previously known drive members, however, the drive member of the present invention includes two outer legs and a central leg. Each leg is substantially planar and the outer legs intersect the central leg at an obtuse angle such that the outer legs are substantially parallel to each other. Furthermore, the central leg is dimensioned so that the intersections of the outer legs with the central leg are spaced apart from each other by a distance substantially equal to the distance between the pins on the driven member attached to the paint can cover.

Unlike the previously known drive members, with the drive member of the present invention, it is unnecessary for the axes of the drive member and driven member to be coaxial with each at the time that the drive member engages the driven member. Rather, the intersections of the outer legs with the central leg of the drive member form V-shaped recesses which, upon engagement with the pins on the driven member, automatically center the paint can beneath the drive shaft so that the drive an driven members are coaxial with each other. As such, the previously known necessity of guides secured to the shelf is rendered unnecessary.

It is, of course, necessary to align the paint can with the drive shaft so that the drive member engages the driven member. In order to accomplish this, a guide bracket is secured to the rack adjacent the drive shaft which, in conjunction with the driven member, ensures that the drive member engages the driven member but without the necessity of accurately vertically aligning the drive and driven members.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which:

FIG. 1 is a diagrammatic fragmentary elevational view illustrating a preferred embodiment of the present invention;

FIG. 2 is a cross-sectional view illustrating one portion of the preferred embodiment of the present invention;

DETAILED DESCRIPTION OF A PREFERRED EMBODIMENT OF THE PRESENT INVENTION

Figure 3:
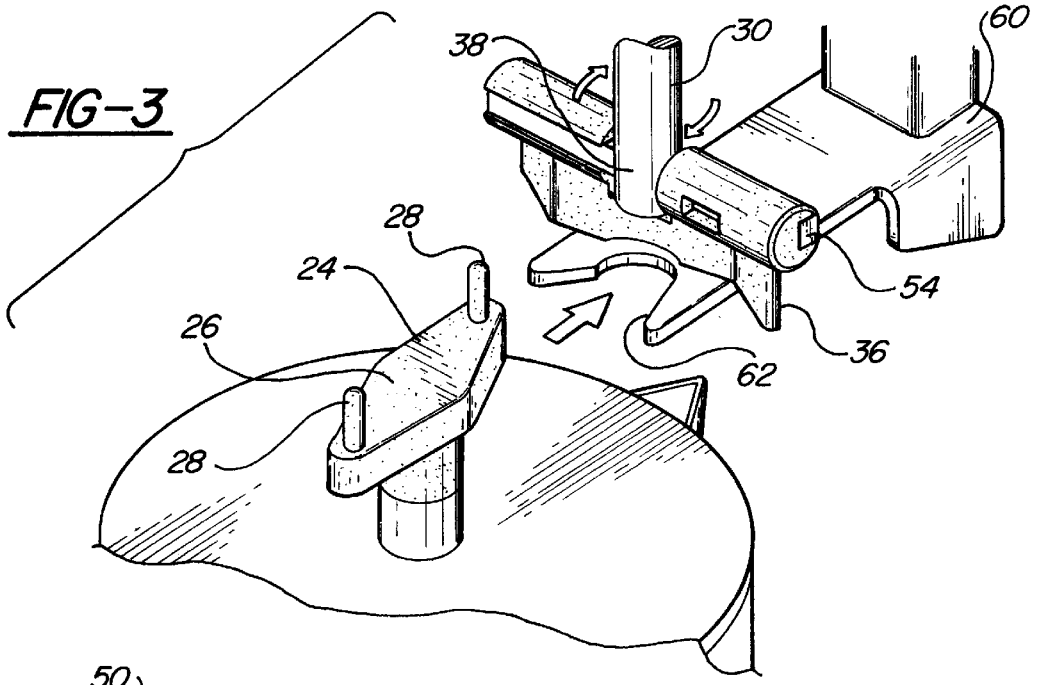
FIG. 3 is an exploded fragmentary view illustrating a portion of the present invention.

With reference first to FIGS. 1 and 2, a portion of an automatic paint stirring mechanism 10 is there shown having a rack 12 with a plurality of horizontally extending shelves 14 (only one illustrated in FIG. 1). Each shelf 14, furthermore, is adapted to support a plurality of paint cans 16 in a side-by-side relationship. Still referring to FIGS. 1 and 2, a conventional paint can cover 18 of the type used in automatic paint stirring equipment is secured across the open top of each paint can 16 in any conventional fashion. A stirring element 20 is contained within the interior of the paint can 16 and is rotatably mounted to the paint can cover 18 by a shaft 22 (FIG. 2). Consequently, in the well-known fashion, rotation of the shaft 22 simultaneously rotates the stirring element 20 and maintains the paint within the paint can 16 in a mixed condition.

With reference now to FIGS. 2 and 3, a driven member 24 is secured to the shaft 22 above the paint can cover 18. The driven member 24 is conventional in construction and, as such, includes an elongated arm 26 having two spaced apart and upwardly extending pins 28 secured to the arm 26. Furthermore, the pins 28 are equidistantly spaced from the axis of rotation of the shaft 22 and are diametrically opposed from each other.

Still referring to FIGS. 2 and 3, a plurality of motor shafts 30 are rotatably mounted about a generally vertical axis to the rack 12 so that one drive shaft 30 is positioned above each paint can 16. A pulley 32 is secured to each drive shaft 30 for rotation therewith while a motor 34 (FIG. 1) rotatably drives the pulleys 32, and thus the drive shafts 30, in unison with each other.

A drive member 36, which will subsequently be described in greater detail, is secured to the lower depending end 38 of each drive shaft 30. In a fashion which will also be subsequently described in greater detail, upon insertion of the paint can 16 onto the shelf 14 to the position illustrated in FIG. 2, the drive member 36 is positioned in between the pins 28 on the driven member 24 so that the drive member 36 and driven member 24 with its attached stirring element 20 rotate in unison with each other.

Figure 4:
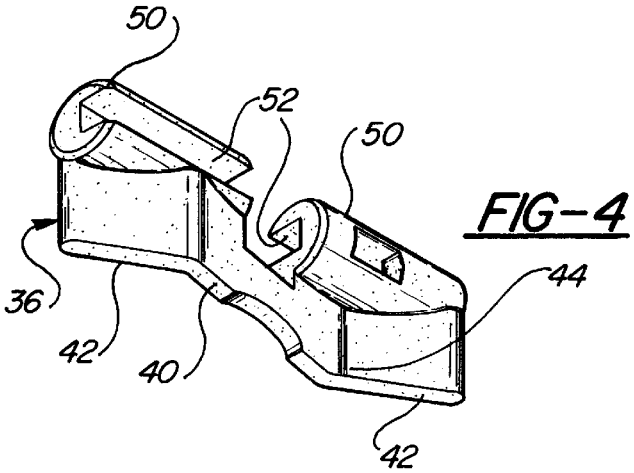
FIG. 4 is an elevational view illustrating the improved drive member of the present invention.

With reference now to FIGS. 2 and 4, the drive member 36 is preferably of a one-piece construction and comprises a central leg 40 and two outer legs 42. The central leg 40 and outer legs 42 are generally planar in construction and are preferably made of a plastic material.

Figure 5A:
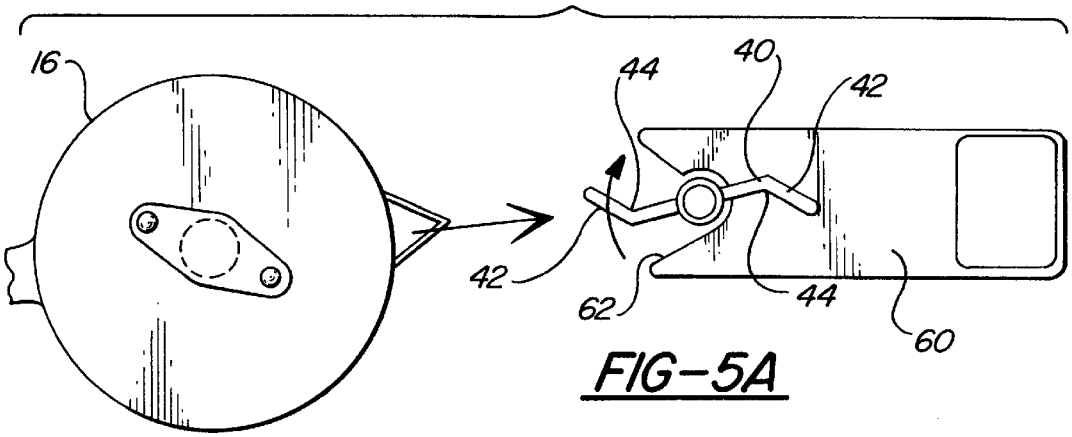
FIGS. 5A–5D are top diagrammatic views illustrating the operation of the preferred embodiment of the present invention.

As best shown in FIG. 5A, the outer legs 42 intersect the central leg 40 at an obtuse angle such that the outer legs 42 are generally parallel to each other. However, a generally V-shaped recess 44 is formed by the intersection of each outer leg 42 with the central leg 40. Furthermore, these recesses 44 are spaced apart from each other by a distance equal to the spacing between the pins 28 on the driven member 24.

The drive member 36 is secured to the lower end 38 of the drive shaft 30 by any conventional means. However, as shown in FIGS. 3 and 4, in the preferred embodiment of the invention the drive member 36 includes a pair of axially aligned and spaced apart bosses 50 formed along one edge of the drive member 36. A longitudinally extending open slot 52 is formed in each boss 50 so that the slot 52 and one boss 50 faces in an opposite direction from the slot 52 in the other cylindrical boss 50.

A pin 54 (FIGS. 2 and 3) extends through a transverse bore at the end 38 of the drive shaft 30 and the pin 54 is dimensioned to be frictionally lockingly received within the recesses 52 of the cylindrical bosses 50. Thus, when assembling the drive member 36 to the drive shaft 30, it is only necessary for the cylindrical bosses 50 to be snapped over the drive pin 54 in order to attach the drive member 36 to the drive shaft 30.

Figure 5B:
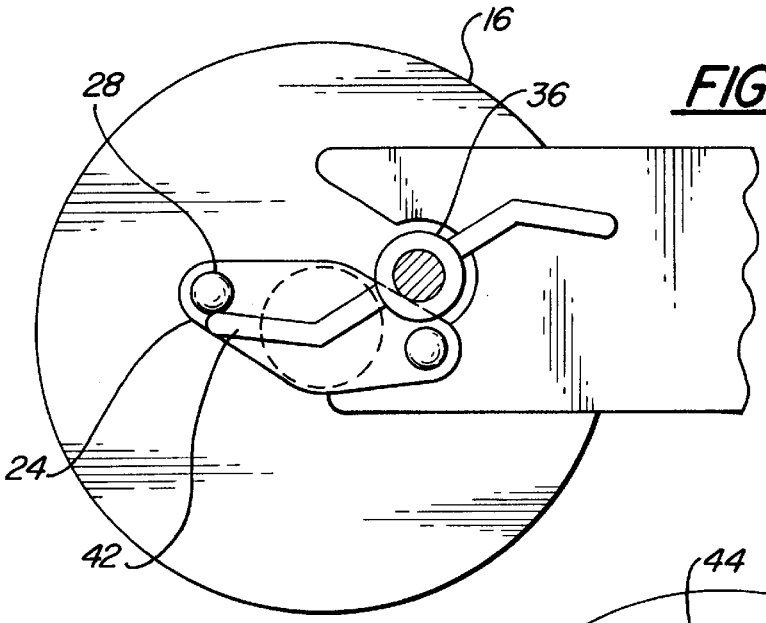
Figure 5C:
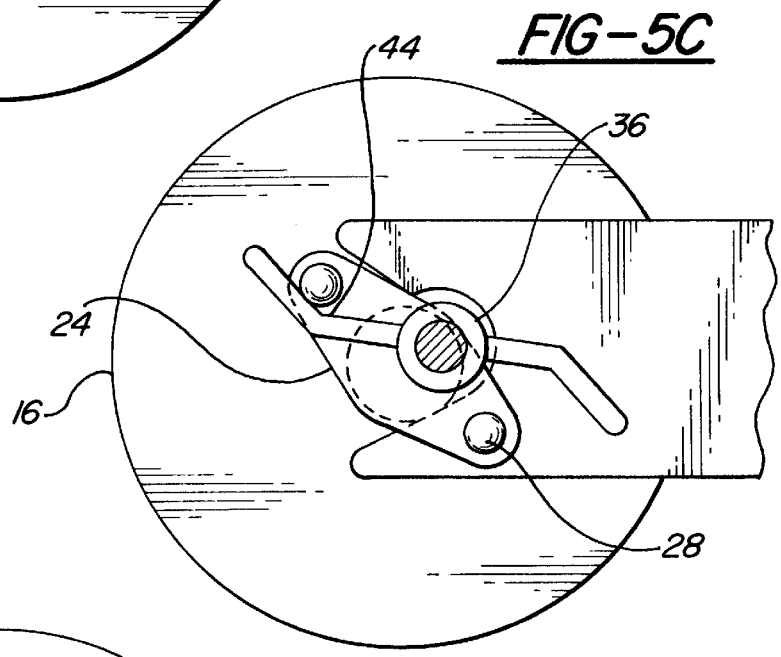

With reference now to FIGS. 5A–5D, upon insertion of the paint can 16 into the rack, the paint can 16 is moved from the position shown in FIG. 5A to the position shown in FIG. 5B in which one of the outer legs 42 of the drive member 36 engages one of the pins 28 on the driven member 24. However, as shown in FIG. 5B, the drive member 36 and driven member 24 are not coaxial with each other.

Further rotation of the drive member 36 in the clockwise direction as viewed in FIGS. 5A–5D causes the pins 28 on the driven member 24 to move to the V-shaped recesses 44 on the drive member 36. In doing so, the engagement between the drive member 36 and driven member 24 moves the driven member 24, and thus the paint can 16, to a position in FIG. 5C in which the axis of the driven member is closer to alignment with the drive member then in FIG. 5B.

Figure 5D:
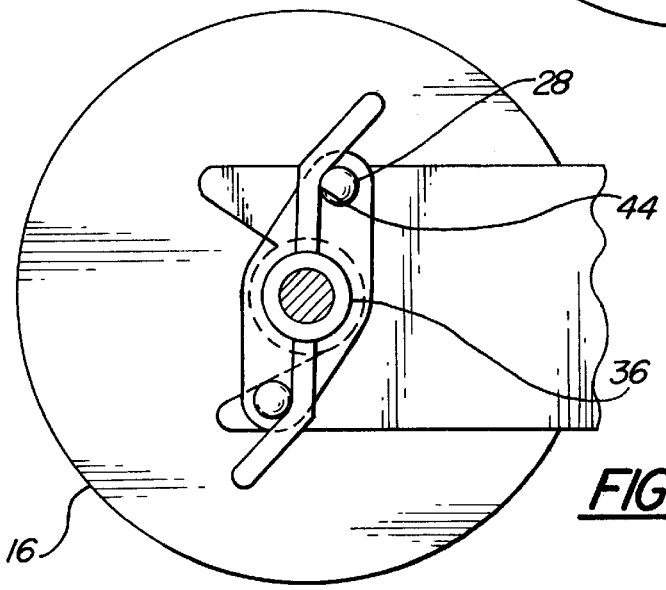

Upon continued rotation of the drive member 36 to the position shown in FIG. 5D, the pins 28 on the driven member 24 will nest within the recesses 44 on the drive member 36 in which the axes of the drive member 36 and driven member 24 are axially aligned with each other. Furthermore, once the pins 28 are positioned within the V-shaped recesses 44 of the drive member 36, the engagement between the drive member 36 and driven member 24 represents the point of least resistance so that further movement of the drive member 36 relative to the driven member 24 will not occur.

As best shown in FIGS. 3 and 5A, a bracket 60 having a generally V-shaped opening 62 is secured to the rack 12 for each drive member 36. The V-shaped opening 62 is dimensioned to receive a portion of the driven member 24 to ensure that the drive member 36 and driven member 24 engage each other upon the insertion of the paint can 16 into the rack 12. However, as best shown in FIG. 5A, the V-shaped opening 62 is much larger in area than the cylindrical portion of the driven member 24 so that the V-shaped opening 62 serves only to ensure that the drive member 36 and driven members 24 merely engage each other but does not otherwise serve to center the axis of the driven member 24 with the axis of the drive member 36.

From the foregoing, it can be seen that the present invention provides a simple and yet highly effective drive member for use with automatic paint stirring equipment for automatically centering the paint cans beneath their respective drive shafts and without the previously known necessity of guides attached to the shelves.

Having described my invention, however, many modifications thereto will become apparent to those skilled in the art to which it pertains without deviation from the spirit of the invention as defined by the scope of the appended claims.

I claim:

1. For use in conjunction with automatic paint stirring equipment of the type having a rack adapted to removably receive and support paint cans, each paint can having a cover, a stirring element contained within the can and a driven member positioned above the cover and mechanically connected to the stirring element, said driven member being rotatable about a predetermined axis, said driven member having two upwardly extending pins spaced apart by a preset distance, an improved mechanism for rotatably driving the stirring element comprising:

a drive shaft, means for rotatably mounting said shaft to the rack so that a first end of said shaft is positioned adjacent the driven member and so that said drive shaft rotates about an axis substantially parallel to said driven member axis, means for rotatably driving said shaft, a drive member, means for mounting said drive member to said shaft for rotation therewith, wherein said drive member includes two outer legs and a central leg, each leg being substantially planar, said outer legs intersecting said central leg at an obtuse angle such that said outer legs are substantially parallel to each other, and wherein said central leg is dimensioned so that the intersections of said outer legs with said central leg are spaced apart from each other by a distance substantially equal to said preset distance between said pins on said driven member.

2. The invention as defined in claim 1 wherein said legs of said drive member are of a one piece construction.

3. The invention as defined in claim 1 wherein said means for mounting said drive member to said drive shaft comprises a cross pin, said cross pin extending through a transverse opening in said drive shaft, and means for securing said drive member to said cross pin.

4. The invention as defined in claim 1 and comprising means for guiding said cans on said rack such that said predetermined axis of said driven member intersects said drive member.

5. The invention as defined in claim 1 and further comprising a guide bracket secured to said rack, said guide bracket having an opening for guiding said driven member into engagement with said drive member.

* * * * *